United States Patent [19]

Sawa et al.

[11] Patent Number: 4,534,155

[45] Date of Patent: Aug. 13, 1985

[54] SOLID MATERIAL PACKING METHOD AND MACHINE

[75] Inventors: Yuji Sawa; Toshio Itoh; Kuniomi Adachi, all of Fukushima, Japan

[73] Assignee: Kureha Kagaku Kogyo Kabushiki Kaisha, Tokyo, Japan

[21] Appl. No.: 372,351

[22] Filed: Apr. 27, 1982

[30] Foreign Application Priority Data

| | | | |
|---|---|---|---|
| Apr. 28, 1981 | [JP] | Japan | 56-63371 |
| May 20, 1981 | [JP] | Japan | 56-71908[U] |
| May 26, 1981 | [JP] | Japan | 56-75190[U] |

[51] Int. Cl.[3] ..... B65B 43/30; B65B 43/16

[52] U.S. Cl. ..... 53/459; 53/571; 53/573

[58] Field of Search ..... 53/573, 572, 384, 385, 53/386, 459, 469, 571; 271/33

[56] References Cited

U.S. PATENT DOCUMENTS

| | | | |
|---|---|---|---|
| 2,612,738 | 10/1952 | Salfisberg | 271/33 |
| 2,973,612 | 3/1961 | McGowan | 53/573 X |
| 3,083,961 | 4/1963 | Arbter | 271/33 |
| 3,206,913 | 9/1965 | Fleigher et al. | 53/385 X |
| 3,427,780 | 2/1969 | Bock | 53/386 X |
| 3,430,409 | 3/1969 | Manfredonia et al. | 53/573 X |
| 3,448,557 | 6/1969 | Swaithes | 53/573 X |
| 3,471,997 | 10/1969 | Berry | 53/386 |
| 3,509,689 | 5/1970 | Perrin | 53/571 |
| 3,881,410 | 5/1975 | Shenoha | 53/385 X |
| 3,945,173 | 3/1976 | Buzzi | 53/386 X |

FOREIGN PATENT DOCUMENTS

| | | | |
|---|---|---|---|
| 683619 | 11/1939 | Fed. Rep. of Germany | 53/571 |

*Primary Examiner*—Horace M. Culver

*Attorney, Agent, or Firm*—Sughrue, Mion, Zinn, Macpeak & Seas

[57] ABSTRACT

A solid material packing method and apparatus are disclosed wherein the plastic film bags are transported from a storage location to a packing location by a pivotable taking member having adhesive surfaces at its free end. The taking member includes an elongate adhesive tape which can be advanced between the transporting of successive bags to renew the adhesive surfaces. A solid material supplying device comprises a pair of conduit-shaped members which are movable toward and away from one another, the conduit-shaped members moving away from one another as they move toward the bag at said packing location to thereby hold open the bag for insertion of a solid material.

25 Claims, 13 Drawing Figures

SOLID MATERIAL PACKING METHOD AND MACHINE

BACKGROUND OF THE INVENTION

This invention relates to a solid material packing method in which a solid material such as ham is packed in a film bag, and to a machine for practicing the method.

In a conventional solid material packing method, a number of film bags, which have been formed according to the size of the solid materials to be packed, are manually picked up one after another and manually opened, and the solid materials are manually packed in the film bags. However, this conventional method is disadvantageous in that, since the packing work is carried out manually, the work efficiency is low especially when large rectangular solid materials are packed.

Furthermore, there is also known a solid material packing method in which a number of film bags are stuck to a piece of adhesive tape in such a manner that they overlap one another, and the film bags are supplied one after another each time a packing cycle is completed, with a packing cycle comprising the opening of a film bag, putting a solid material into the film bag and removing the film bag, so that solid materials are continuously packed. However, this latter method is still disadvantageous in that both the forming of the assembly of film bags stuck to the piece of adhesive tape and the setting of the assembly of film bags are troublesome.

There are also known packing machines in which a vacuum operated suction and retaining head is employed to remove the bags from a stack one at a time, but this is still disadvantageous in that it is difficult to positively pick up the thin plastic bags, and the bags are also sometimes wrinkled.

Solid material packing machines also differ in their particular means for supplying the material into the bag. In the case where a relatively thick, cylindrical material is to be packed into a bag, it is common to place a sufficiently opened bag in front of the front end portion of a cylindrical chute, and the material is then delivered into the bag through the chute. However, in such a system, it is necessary to provide an intricate mechanism for opening the mouth of the bag and for placing the opened bag in front of the chute. When the size of the materials to be packed is changed, it is difficult to quickly respond to this change.

SUMMARY OF THE INVENTION

Accordingly, an object of this invention is to provide a solid material packing method in which the above-described drawbacks accompanying a conventional solid material packing method have been eliminated and solid materials can be automatically packed with high efficiency.

It is a further object of this invention to provide a solid material packing machine for practicing such a method.

Provided according to this invention are a solid material packing method and machine in which a plurality of plastic film bags, each of which has an opening at one end and a sealed or knotted bottom at the other end, are stacked upon one another to form a stack of plastic film bags which are supported by a support member at at least two points near the opening so that the bags can be removed. The support member of the stack of plastic film bags is preferably detachably set on mounting means, and the bags are removed from the stack of film bags one at a time by sticking and removing means. The sticking and removing means preferably comprises: pressing and sticking members which operate to remove the top one of the stack of film bags by causing adhesive tapes to press against and stick to the top film bag at at least two points near the opening thereof and to release the top film bag when a solid material is packed therein; means for feeding the adhesive tapes to replace the pressing and sticking surfaces whenever a film bag is removed; and a support for supporting the pressing and sticking members. The opening of the film bag is set at a packing position in a solid material supplying means by a movable sticking, removing and supplying means which is obtained by mounting the sticking and removing means on another support. The film bag is inflated by jetting air to the opening of the film bag thus removing, and the film bag is released from the sticking and removing means included in the sticking, removing and supplying means by putting a solid material into the film bag through the opening thereof, to thereby obtain a packed solid material.

A more specific feature of the invention resides in a pair of conduit-shaped holding plates which are designed so as to perform the operations of holding a material to be packed, holding the bag open and placing the material into the bag.

BRIEF DESCRIPTION OF THE DRAWINGS

The invention will be more clearly understood from the following description in conjunction with the accompanying drawings, wherein.

DETAILED DESCRIPTION OF THE INVENTION

Figure 1:
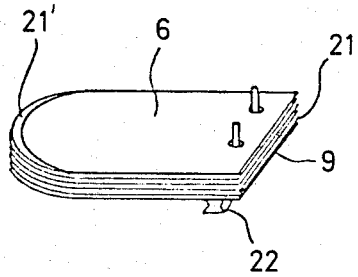
FIGS. 1 and 2 are perspective views of examples of a stack of film bags employed in this invention.
Figure 2:
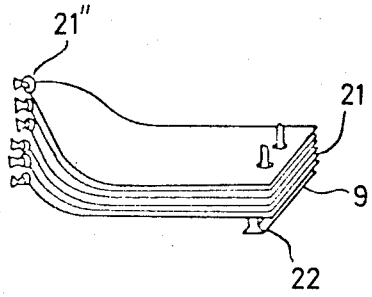

The figures in the accompanying drawings will now be described. FIG. 1 shows a bag cassette 9 comprising a stack of film bags 6 which are bound together with a support member, e.g., a plastic fastener 22. Each film bag 6 has a sealed bottom 21' at one end, and an opening 21 at the opposite end. FIG. 2 shows another example of the bag cassette 9 which is different from that in FIG. 1 in that each film bag has a knotted bottom 21'' instead of a sealed bottom.

Figure 3:
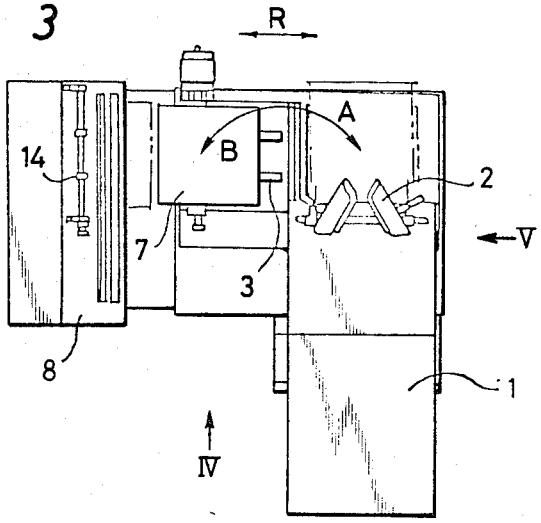
FIG. 3 is a plan view of a solid material packing machine according to the invention.
Figure 4:
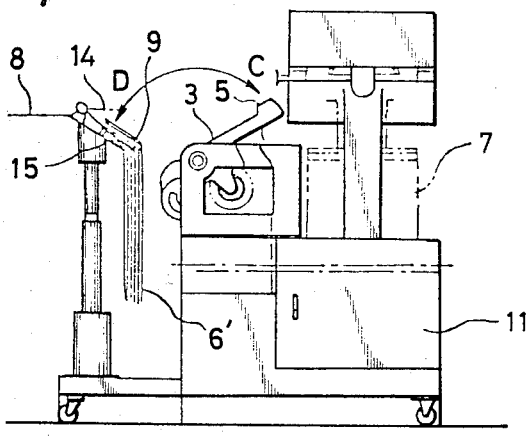
FIG. 4 is a side view of the machine as viewed in the direction of the arrow IV in FIG. 3.
Figure 5:
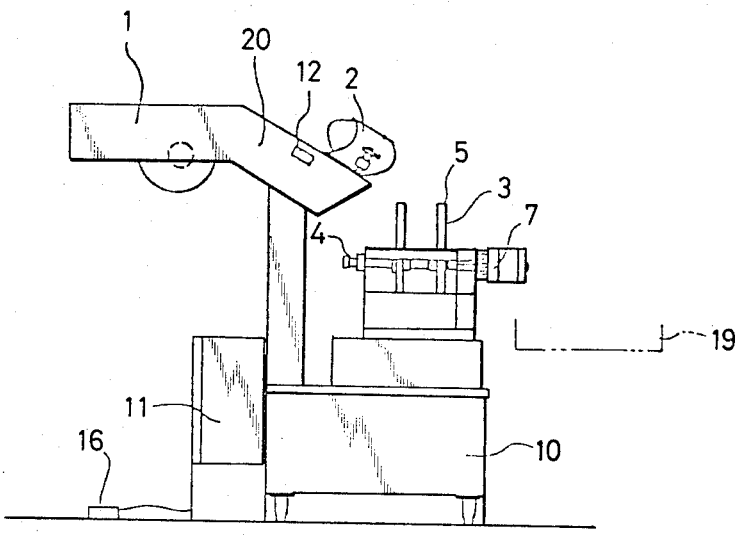
FIG. 5 is also a side view of the machine as viewed in the direction of the arrow V in FIG. 3.

FIG. 3 is a plan view of a solid material packing machine according to this invention. FIG. 4 is a side view of the machine as viewed in the direction of the arrow IV in FIG. 3. FIG. 5 is also a side view of the machine as viewed in the direction of the arrow V in FIG. 3. The stack of film bags, or the bag cassette 9, is detachably mounted on a mounting means, in the form of a mounting stand 8. More specifically, the bag cassette 9 is mounted on the mounting stand 8 by laterally inserting the fastener 22 into a dovetail groove 15 formed in the mounting stand 8. The dovetail groove 15 is formed in the front surface of the mounting stand 8 in such a manner that it extends from one side of the stand to the other. When the present bag cassette 9 has been used up, its fastener 22 is pushed out, and then a new bag cassette 9 is set on the mounting stand. The stand 8 may be wide enough to accommodate two bag cassettes, in which case a bag cassette to be used next may be provided beside a bag cassette being used.

Figure 6:
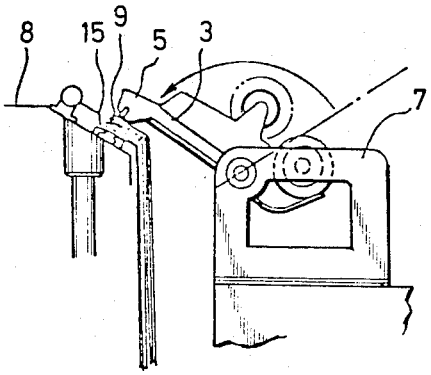
FIGS. 6 and 7 are explanatory diagrams showing a bag removal operation in the machine.
Figure 7:
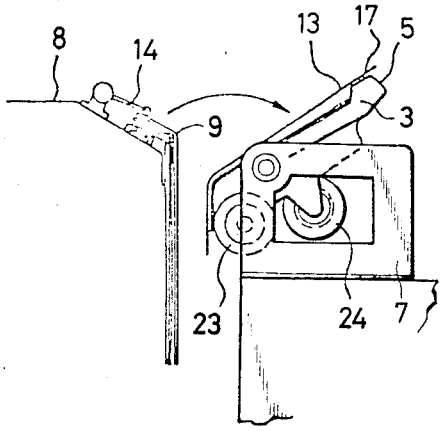
Figure 8:
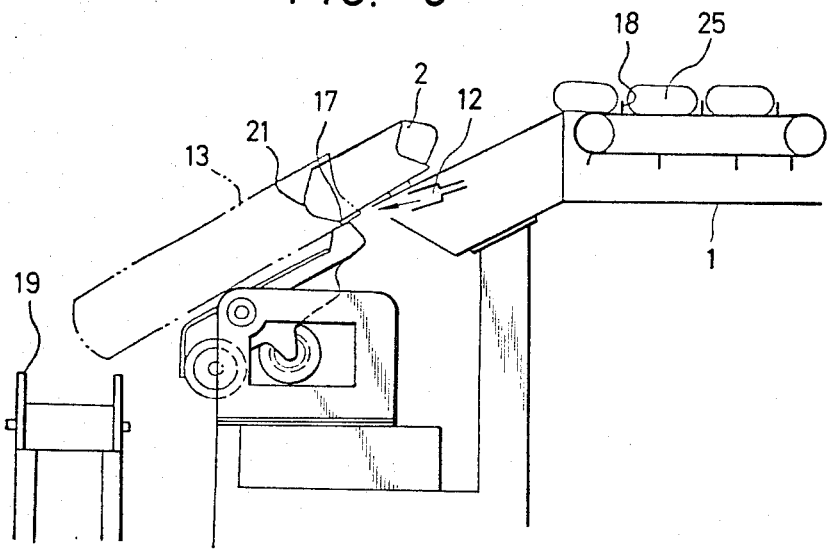
FIG. 8 is an explanatory diagram showing one example of a solid material packing operation in the machine.

FIGS. 6, 7 and 8 are diagrams for a description of the operation of the solid material packing machine. The bag cassette 9 which is a stack of film bags is set on the mounting stand 8. In FIGS. 5 and 8, reference numeral 1 designates a solid material sliding stand on which a solid material is placed. The solid material thus placed slides down the stand 1 into an awaiting bag as shown in FIG. 8.

A sticking, removing and supplying means comprises a sticking and removing means mounted on a support, and comprises a take-up unit 7 in FIG. 6. The take-up unit 7 can be turned in a horizontal plane from a position A where a solid material supplying means is positioned as shown in FIG. 3 to a position B. The unit 7 is shown in solid outline in its position B in FIG. 4, while the dotted outline designated by reference numeral 7′ in FIG. 4 represents position A. In position B, the take-up unit 7 can be moved in the direction of the arrow R in FIG. 3, in response to an operation signal from a foot switch 16, so as to be ready for removing the top one 6′ of the stack of film bags. A pivoting sticker 3 which is the sticking and removing means of the take-up unit 7 has at least two sticking tape members 5 at its outer end. With the unit 7 in position B, the sticker 3 is pivoted counterclockwise in FIG. 4 to press against and stick to the topmost bag 6′. After the take-up unit 7 has been thus operated, the sticker 3 is pivoted clockwise so that the sticking tape members 5 are moved from a position D (FIG. 4) where they press against the bag cassette 9, to a position C (FIG. 4) (i.e., the sticking tape members 5 are swung from the position as shown in FIG. 6 to the position as shown in FIG. 7 while carrying a film bag designated by reference numeral 13 in FIG. 7). Then, the take-up unit 7 is turned in a horizontal plane while moving laterally from the position B to the position A shown at 7′ in FIG. 4. As a result, the opening 21 of the film bag 6 is directed to the solid material sliding stand 1 and a sloped stand 20 extended therefrom, as shown in FIG. 5 or 8. Thereupon, an air nozzle 12 disposed below the sloped stand 20 as shown in FIG. 8 jets air into the bag 6 through its opening 21, to inflate the film bag 6.

The inflation of the bag is detected by a conventional detecting means such as an optical device. In response to a detection signal from the detecting device, the solid material to be packed is put into the inflated bag through a solid material supplying funnel 2, and the film bag stuck to the sticking tape member 5 is released from the latter 5, preferably by the weight of the solid material, when the solid material is put into the bag, so that the film bag containing the solid material is dropped onto the conveying means 19. In FIG. 5, reference numeral 10 designates a supporting stand; and 11, a power source.

A film bag retaining member 14 is preferably provided in the sticking and removing section, which retaining member slides on the open ends of film bags to ensure that only one film bag is taken out whenever the tape heads 17 swing in a vertical plane (FIGS. 6 and 7). The film bag transport operation of the sticking and removing section is as follows: after the sticking tape members have been moved from the position D to the position C, and in response to a signal indicating this movement, the takeup unit 7 is moved from the position B to the position A (FIG. 3) so that the opening of a film bag is turned, in a horizontal plane, through 90° from a direction in parallel with the front edge of the stand 8 to a direction in parallel with the front edge of the stand 20 and is moved laterally from the position in FIG. 4 to the front of the stand 20 (i.e., the position A in FIG. 3 which is also shown at 7′ in FIG. 4). The movement from the position B to the position A may be effected after the movement from the position D to the position C, or these movements may be started substantially simultaneously. In the case where the aforementioned film bag retaining member 14 is provided, it is preferably to start the movement from the position B to the position A after the operation of the film bag retaining member 14 has been finished during the movement from the position D to the position C.

The sticker 3, which is the pressing and sticking means of the take-up unit 7, preferably has at least two sticking tape members 5 at the top, as was described before. Each sticking tape member 5 is made up of an adhesive tape and a tape head 17 which serves as a support in pressing against the cassette bag. When necessary, the sticking area can be changed by replacing the tape head 17. The sticking tape member is designed so as to have a new sticking surface at all times, as will be described later, by feeding the adhesive tape. More specifically, whenever a film bag 6 is taken out, the adhesive tape is fed 2 to 10 mm, preferably 2 to 3 mm, by a one-way clutch mechanism or the like. It is preferable that, after the take-up unit 7 is turned and moved laterally from the position A to the position B, the adhesive tape may be fed prior to the next swinging operation of the take-up unit 7. However, it is more preferable that, while the take-up unit 7 is being operated as described, the adhesive tape is fed during movement of the unit from position C to position D.

The adhesive tape of the sticking tape member 5 may be any one of a variety of adhesive tapes, and a commercially availabe adhesive tape in the form of a roll may be employed as the adhesive tape of the sticking tape member 5. It is desirable to provide an adjusting handle 4 so that the distance between the two sticking tape members 5 can be adjusted according to the width of a film bag with the inflation of a film bag taken into consideration. Furthermore, in order that the sticking area of the adhesive tape to a film bag can be adjusted according to the weight of a solid material to be packed, it is desirable that the pressing area of the tape head 17, which serves as the support in pressing the adhesive tape against the bag cassette, is adjustable. In this connection, the replacement of the tape head 17 may be the most convenient way of adjusting the pressing area.

Heretofore, it has been common to suctionally retain a film bag by the use of a vacuum for purposes of transporting and handling the bag. However, such a method is liable to fail in removing a film bag, and the use of the adhesive tape as described above can result in a more positive operation. As shown in FIG. 7, the adhesive tape may be supplied from an adhesive tape supply reel, caused to pass around the tape head 17, and can then be wound on a winding reel 24.

Figure 9:
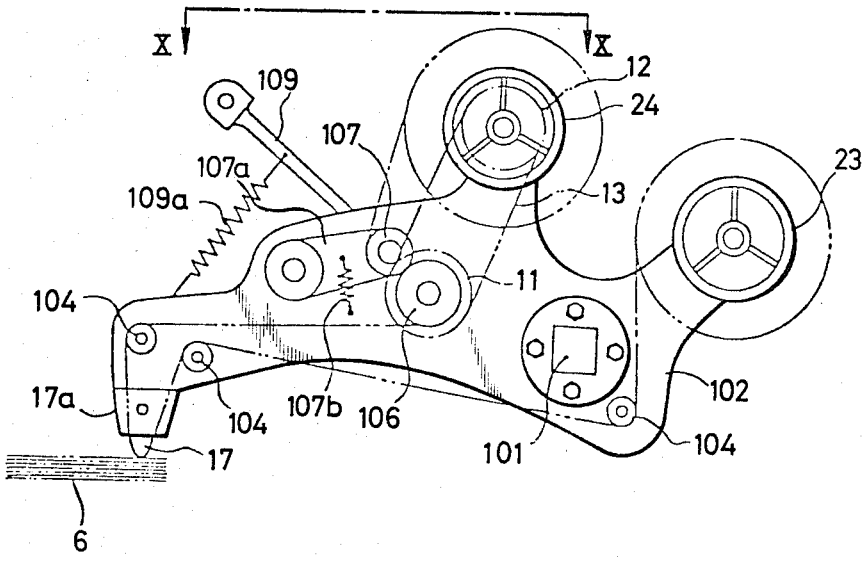
FIG. 9 is a side view of one example of a sticking and taking device according to this invention.
Figure 10:
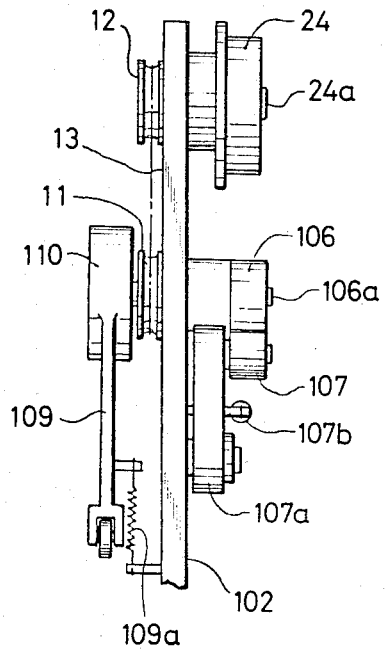
FIG. 10 is a view in the direction of the arrow X—X in FIG. 9.

FIG. 9 is a side view of a specific preferred example of a sticking and removing device according to this invention. FIG. 10 is a view in the direction of the arrow X—X in FG. 9. In these figures, reference numeral 101 designates a rotary shaft; 102, a base plate which is secured to a suitable portion of the rotary shaft 101 in such a manner that it is perpendicular to the latter 101; and 23, a reel on which an adhesive tape roll to be used is mounted. The adhesive tape roll may be a commercially available cellophane tape roll as described above.

Further, in these figures, reference numeral 104 designates a guide roll for introducing the tape to a removing head 17 which can be replaced by one different in tip area and which has guides 17*a* on both sides of the head 17; 106 and 107, pinch rolls, the pinch roll 106 being turned intermittently by a drive shaft 106*a*, and the pinch roll 107 being pressed against the pinch roll 106 by a coil spring 107B which is elastically connected to a lever 107*a*; and 24, a winding reel for winding the used tape.

A ratchet unit 110 provided on the rear side of the base plate 102 is mounted on the shaft 106*a* of the pinch roll 106, and a lever 109 extended from the ratchet unit 110 is elastically urged by a spring 109*a* in a counterclockwise direction with respect to plate 102. In this way, the pinch roll 106 is turned intermittently with suitable timing by engaging the lever 9 during counterclockwise rotation of the plate 102. As the rotary shaft 101 is rotated, the head 17 is pressed against, adheres to and carries away a bag out of a stack of bags 6 to a predetermined position and then returns to its original position. In this operation, the lever 109 is turned through a predetermined angle preferably during the downward stroke (counterclockwise) of the plate 102, by engaging the free end of the lever 9 with an abutment protrusion (not shown), as a result of which the pinch roll 106 is turned slightly to feed the tape about 5 mm, the exact feed amount being adjustable in accordance with a number of factors including, e.g., the sticking area of the head 17. Thus, the top of the taking head 17 is maintained adhesive at all times.

The winding reel 24 is turned by a belt 113 which is laid over a pulley 111 connected to the shaft 106*a* and over a pulley 112 connected to the shaft 24*a*. In this connection, a slip means is necessary since the diameter of the tape wound on the winding reel 24 will change with time. It is preferable that a conventional brake means is provided for the reel 23 so that tension is maintained in the tape at all times. The surfaces of the rolls are preferably finely knurled in order to prevent adhesion between the rolls and the tape; however, it is desirable that the materials of the rolls be taken into account in determining the degree and the amount of knurling.

In practice, two of the devices shown in FIGS. 9 and 10 are juxtaposed, so that a bag or the like is removed by adhering to two points near the mouth thereof. The bag thus removed is moved to a predetermined position, as described above, where it is inflated by jetting air towards its mouth and, under this condition, the material to be packaged is put into the bag.

The solid material supplying funnel in the solid material supplying section, namely, an assist funnel assembly 2, is provided on the front end of the stand 20. The funnel assembly 2 can be replaced according to the size and configuration of the solid material to be packed. The funnel assembly 2 is used to positively insert a solid material into an inflated film bag. The funnel assembly 2 is preferably made up of a pair of funnel pieces as shown in FIG. 3, and the funnel pieces are so set that the front ends thereof are closed to hold a solid material. As soon as a film bag is inflated by air jetted from the air nozzle 12, the funnel assembly 2 is moved towards the film bag. When the front ends of the funnel pieces are inserted into the film bag, the front ends are opened to hold open the open end of the film bag while allowing the solid material to drop into the film bag.

When air is jetted towards the opening of a film bag by the air nozzle 12, the air which is at first not applied to the opening of the film bag will follow along the upper surface of the film bag to form a negative pressure thereon, to thereby open the film bag. Thus, the air is positively introduced into the film bag. In the case where the solid materials to be packed are meat such as ham, the front ends of the funnel pieces can be made slippery by the fat of the meat, and accordingly the solid materials may drop down the funnel assembly before it is intended to put them into the film bags. If the bag opening has not been positively secured by the funnel assembly, the meat may not pass into the bag properly. In order to prevent this problem, it is desirable that means for supporting a film bag, such as knurled members or needle-like protrusions, are provided on the outside surfaces of the funnel pieces which are brought into engagement with the film bag.

In one example of the solid material packing machine in FIG. 8, a solid material supplying conveyor 8 is provided on the solid material sliding stand 1 for supplying solid materials. The conveyor 8 operates to supply the solid materials 25 one at a time in association with the film bag inflating operation described before. A film bag, after being filled with a solid material, is released from the funnel assembly and dropped onto the conveying means 19, so that it is delivered to the next process, for instance, for vacuum packing.

It is preferable to employ an automatic operation control device which uses a conventional optical detecting mechanism to allow the operation of the sticking, removing and supplying section, the operation of the film bag inflating section and the operation of the solid material supplying section to coordinate with one another in response to the operation of the foot switch 16.

A particular material supplying device according to this invention will now be described with reference to FIGS. 11 through 13.

Figure 11:
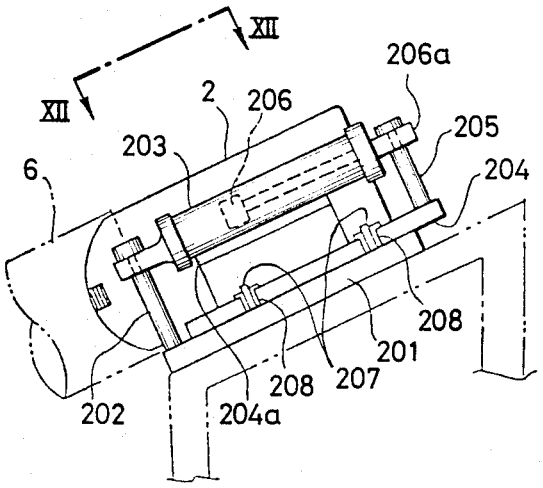
FIG. 11 is a side view of a solid material supplying device according to this invention.

FIG. 11 is a side view showing the essential components of a solid material supplying device according to the invention. FIGS. 12 and 13 are views in the direction of the arrow XII—XII in FIG. 11.

In FIG. 11, reference numeral 201 designates a stationary board which is fixedly secured to a machine body in such a manner that it is inclined; 202, a post which is embedded upright in the stationary board 201; 203, an oil pressure or air pressure cylinder; and 204, a slide board which is slidable on the stationary board 201. Another post 205 is embedded upright in the slide board 204, and is coupled to the shaft 206*a* of a piston 206 which is fitted in cylinder 203. A plurality of pins 207 are embedded upright in the stationary board 201, and are slidably engaged with grooves cam 208 which are formed in the slide board 204. Further in FIG. 11, reference numeral 6 designates a bag; and 2, a conduit-shaped holding plate which is secured to the flange 204*a* of the slide board 204.

Figure 12:
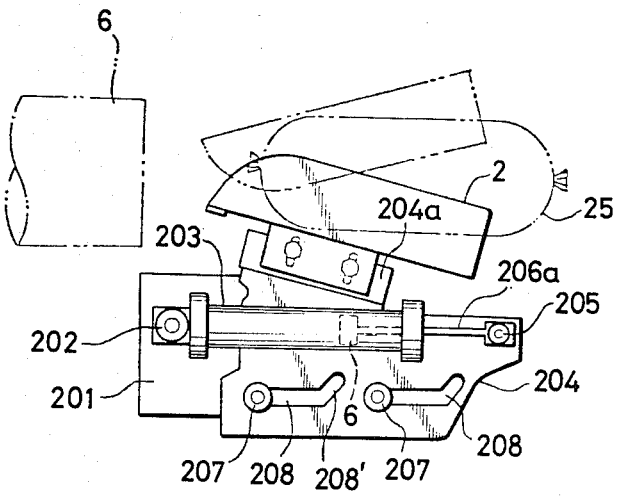
FIGS. 12 and 13 are views in the direction of arrow XII—XII in FIG. 11, for a description of the operation of the holding plates in FIG. 1 in association with the movement of slide boards.

FIG. 12 is a view in the direction of the arrow XII—XII in FIG. 11, showing one of the pair of units which form the solid material supplying device. In the case of FIG. 12, the device is ready for operation. That is, the piston 206 is moved to the right in FIG. 12. One pair of holding plates 2 are so set that the front ends thereof are closed to hold a solid material 25 to be packed.

Figure 13:
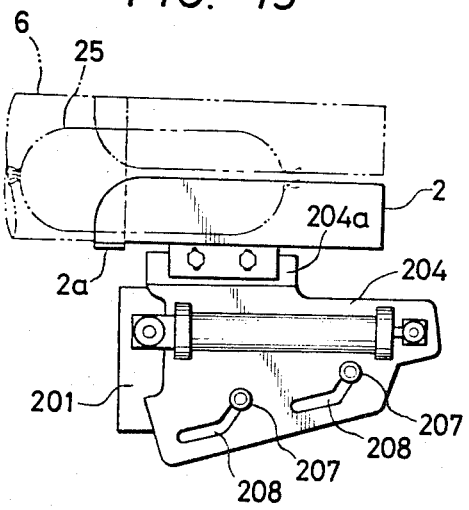

FIG. 13 shows the solid material 25 which is being delivered into the bag 6. In this operation, the piston 206 is moved to the left so that the slide board 204 together with the holding plate 2 is moved towards the bag 6. While the holding plate (plates) 2 is moved into the bag 6, the pins 207 slide along the cam grooves 208 to the bent portions 208' thereof. Accordingly, the slide boards 204 are opened outwardly, and simultaneously the pair of holding plates 2 are also opened outwardly, so that the holding plates 2 are set in parallel with each other to sufficiently open the mouth of the bag. As a result, the solid material, which has unitl this time been held by the holding plates, is dropped into the bag by its own weight. In FIG. 13, reference character 2*a* designates a knurled piece which positively holds the bag whose mouth has been opened.

The bag 6 is delivered to the solid material supplying device by a means described hereinabove, and it is inflated by an air jetting means such as an air nozzle to the extent that the front ends of the holding members 2 can be inserted into the bag.

When the solid material 25 reaches the bottom of the bag 6, the latter 6 is pulled from the holding plates 2 by the weight of the solid material and is then delivered to the next process via conveyor 19 in FIG. 8. Thereupon, the piston 206 is moved to the right and the slide board 204 is also moved to the right, as shown in FIG. 12. At the same time, the holding plates 2 receive and hold the next solid material while retracting to the position shown in FIG. 12. The holding plates 2 can be readily adjusted or replaced according to the size and configuration of the solid materials to be packed.

In the solid material packing method and machine according to the invention, stacks of film bags which can be readily loaded on or unloaded from the machine are employed. Therefore, the solid materials can be packed with high efficiency. The film bags are taken out by the pressing and sticking surfaces of the sticking tape members, which are new at all times, and therefore they can be positively removed. Even unstiff film bags can be positively removed. Further, the tape handling mechanism is simple and compact in construction, and the solid material supplying device operates effectively to not only control the supply of material into the bag but also to hold the bag open. Thus, the solid materials can be packed with high efficiency.

What is claimed is:

1. A packing method of the type comprising the steps of transporting one of a plurality of bags from a storage location to a packing location and inserting a material into said bag, the improvement characterized in that said transporting step comprises:

pressing against said one bag with a member having at least one exposed adhesive surface thereon;

pivotably moving said member from a first position in which it presses against said one bag at said storage location to a second position in which it holds and supports said one bag; and laterally translating said member in a horizontal plane to a third position arranged at the end of a packing slide, whereat said one bag is opened to receive said material, said one bag remaining adhered to said member until said material is inserted into said bag.

2. A method as defined in claim 1, wherein said at least one adhesive surface comprises a pair of exposed adhesive surfaces.

3. A method as defined in claim 1, wherein a plurality of bags are transported one at a time from said storage location to said packing location, said method further comprising the step of changing said exposed adhesive surface between the transporting of each of said plurality of bags.

4. A method as defined in claim 3, wherein said exposed adhesive surface comprises a portion of an elongated adhesive tape carried by said taking member, said changing step comprising advancing said tape.

5. A method as defined in claim 4, wherein said tape is engaged by a roller rotatably mounted to said member and ratchetwise coupled to a ratchet lever for unidirectional rotation with respect thereto, said changing step comprising engaging said ratchet lever during movement of said member to thereby cause relative movement between said ratchet lever and said member and consequent rotation of said roller with respect to said member to thereby advance said tape.

6. A method as defined in claim 1, wherein the improvement is further characterized in that said inserting step comprises opening said bag with at least one guide member.

7. A method as defined in claim 6, wherein said at least one guide member comprises a pair of guide members movable toward and away from one another, and said opening step comprises moving said guide members away from one another after assuming a position in which at least tip ends of said guide members are within said bag.

8. A method as defined in claim 6 or 7, wherein said opening step further comprises generating an air flow toward the open end of said bag.

9. A solid material packing method comprising the steps of:

providing a plurality of plastic film bags each of which has an opening at one end and a sealed or knotted bottom at the other end, said plurality of film bags being stacked upon one another with the stack of plastic film bags being supported by a support member at at least two points near said opening;

removing said plastic film bags one at a time from said stack by pressing against said stack at least one member having adhesive surfaces for engaging each bag at at least two points near said bag opening and moving said member to remove a bag from said stack of bags and to transport said bag to a packing location by pivoting and rotationally translating said member horizontally;

opening said film bag at said packing location; and inserting said solid material into said opened film bag to remove said bag from said adhesive surfaces.

10. A method as defined in claim 9, further comprising the step of replacing said exposed adhesive surfaces between the transporting of each bag.

11. A method as defined in claim 9, wherein said step of opening comprises jetting air into the opening of said film bag.

12. A packing apparatus of the type wherein one of a plurality of bags is transported from a storage location to a packing location and a material is then inserted into said bag, said apparatus comprising:

a member having at least one exposed adhesive surface thereon, said member being pivotable between a first position in which said adhesive surface presses against and adheres to said one bag at said storage location, a second position at which it holds and supports said bag; and being horizontally movable to a third position wherein said bag is located at said packing location, means for opening said bag, means for loading said material into said bag, said adhesive surface being selected such that the loading of said material operates to detach said bag from said member.

13. An apparatus as defined in claim 12, wherein said at least one adhesive surface comprises a pair of adhesive surfaces.

14. An apparatus as defined in claim 12, wherein said taking member comprises an elongated adhesive tape arranged between take-up and supply reels with a portion of said adhesive tape comprising said exposed adhesive surface, said taking member further comprising means for advancing said tape in order to replace said exposed adhesive surface.

15. An apparatus as defined in claim 14, wherein said means for advancing comprises an advancing roller engaging said tape, a lever ratchetwise connected to said advancing roller for unidirectional rotation with respect thereto, and abutment means for engaging said lever during movement of said taking member to thereby cause rotation of said advancing roller.

16. An apparatus as defined in any one of claims 12–15, further comprising means for adjusting the size of said exposed area in accordance with the weight of the material to be packed.

17. An apparatus as defined in claim 12, further comprising air blower means for providing a flow of air toward said bag to open said bag at said packing location.

18. An apparatus as defined in claim 12, wherein said plurality of bags are each provided with at least a pair of spaced holes near the openings thereof, said plurality of bags being provided in a stack, and including a stack support means comprising at least two pins insertable through said holes.

19. An apparatus as defined in claim 18, wherein said stack support means further comprises a mounting member and a stack supporting member on which said pins are supported, said stack supporting member being slidably mounted on said mounting member for sliding movement in a direction generally perpendicular to the extension direction of said pins.

20. An apparatus as defined in claim 18, further comprising a bag retaining member which engages said stack of bags and slides from one bag to the next as said one bag is removed from said stack to thereby allow only one bag to be removed from said stack at a time.

21. An apparatus as defined in claim 12, wherein said means for loading said material into said bag at said packing location comprises a pair of guide members movable generally toward and away from one another, and means for moving said guide members away from one another to open said bag.

22. An apparatus as defined in claim 2, wherein said means for moving said guide members comprises a slidable plate on which at least one of said guide members is mounted, camming means cooperating with said sliding plate to move said sliding plate away from the other of said guide members as said sliding plate is moved toward said bag, and means for moving said slidable plate toward said bag.

23. An apparatus as defined in claim 21 or 22, wherein each of said guide members includes a knurled portion for engaging the interior of said bag opening.

24. An apparatus as defined in claim 12, wherein said member is pivotally mounted to a member support for pivoting motion in a vertical plane, and said member support is rotatable and laterally movable in a horizontal plane during or after the pivoting of said member.

25. A bag transporting device for use in a solid material packing apparatus, said bag transporting device comprising:

a rotatable base plate having thereon at least one adhesive head;

a supply reel for providing a supply of adhesive tape;

a take-up reel for taking up used adhesive tape;

guide rolls for guiding said adhesive tape from said supply roll to said take-up roll past said head;

at least one pinch roll provided on said base plate and engaging said adhesive tape; and a lever ratchetwise connected to said at least one pinch roll and movable with respect to said base plate for advancing said adhesive tape past said head, and an abutment for engaging said lever during movement of said head.

* * * * *